US006868792B2

(12) United States Patent
Hayden

(10) Patent No.: US 6,868,792 B2
(45) Date of Patent: Mar. 22, 2005

(54) LANE POWER

(76) Inventor: Joseph W Hayden, 301 Bright Water Rd., Old Lyme, CT (US) 06371

( * ) Notice: Subject to any disclaimer, the term of this patent is extended or adjusted under 35 U.S.C. 154(b) by 0 days.

(21) Appl. No.: 10/233,350

(22) Filed: Dec. 9, 2002

(65) Prior Publication Data

US 2004/0107864 A1 Jun. 10, 2004

(51) Int. Cl.[7] ..... A63G 1/00
(52) U.S. Cl. ..... 104/60
(58) Field of Search ..... 104/53, 60, 287, 104/288, 295, 305

(56) References Cited

U.S. PATENT DOCUMENTS 4,200,287 A * 4/1980 Ryan et al. ..... 463/63
4,295,649 A * 10/1981 Cooper ..... 463/59
5,218,909 A * 6/1993 Ng ..... 104/60
5,813,351 A * 9/1998 Chen ..... 104/60

* cited by examiner

*Primary Examiner*—S. Joseph Morano
*Assistant Examiner*—Robert J. McCarry, Jr.

(57) ABSTRACT

The nature of this invention" is directed to an electrical power source for slot cars. What is new in this invention is the introduction of an adjustable regulated direct current power supply over an existing fixed direct current power supply.

15 Claims, 2 Drawing Sheets

LANE POWER

BACKGROUND AND FIELD OF THE INVENTION

This invention relates generally to a power supply used for model racing cars (e.g., slot cars) that run on slot car tracks. More particularly, it enables a hobbyist to fine-tune the direct current voltage regulation by adjusting the voltage, therefore compensating for voltage variation in the slot car's electric motor and allowing the slot car to run both independently and in conjunction with a controller.

A power supply apparatus for slot car racing tracks is known. Such a power supply generally comprises one fixed power pack supplying the same amount of power to each of the slot car track lanes. The fixed power pack supplies power to the rails or braids referring to the electrical pickups physically located on each side of the slot in the track which engage with corresponding pickups or brushes on the slot car so that a driving electrical motor in the slot car may be powered. Each slot car track is operably connected to a controller which draws power from one fixed power supply to adjust a resistance to the fixed power available each slot car via a corresponding track and thus control the speed of the slot car.

The simplest form of a slot car track comprises two substantially parallel slot car lanes with cars powered by a single fixed power supply. Each lane has a controller associated therewith which controls an amount of power available to the associated track. Since there is two tracks and one fixed power supply, each track has one half of the power of the fixed power supply available.

However, such slot car tracks having a fixed power supply have a disadvantage in that each slot car's electric motor has to be that of the same voltage requirement to operate competitively. Another disadvantage includes lack of adjustment to regulate the fixed power supply to alter the power or voltage available to each track. Still another disadvantage is the requirement of two people having to operate two slot cars on a two track system, for example; one slot car cannot operate independently through the fixed power supply.

Accordingly, there is a need for an adjustable power supply apparatus which eliminates the above disadvantages.

SUMMARY OF THE INVENTION

One aspect of the invention is to provide an adjustable power supply which will easily adapt to existing slot car track systems.

Another aspect of the invention is to provide an adjustable power supply which will allow for variable voltage regulation of an electric motor for each slot cars.

Still another aspect of this invention is to allow each slot car to operate and be controlled through the adjustable power supply independently, or in line with a controller for competitive racing purpose.

Figure 1:
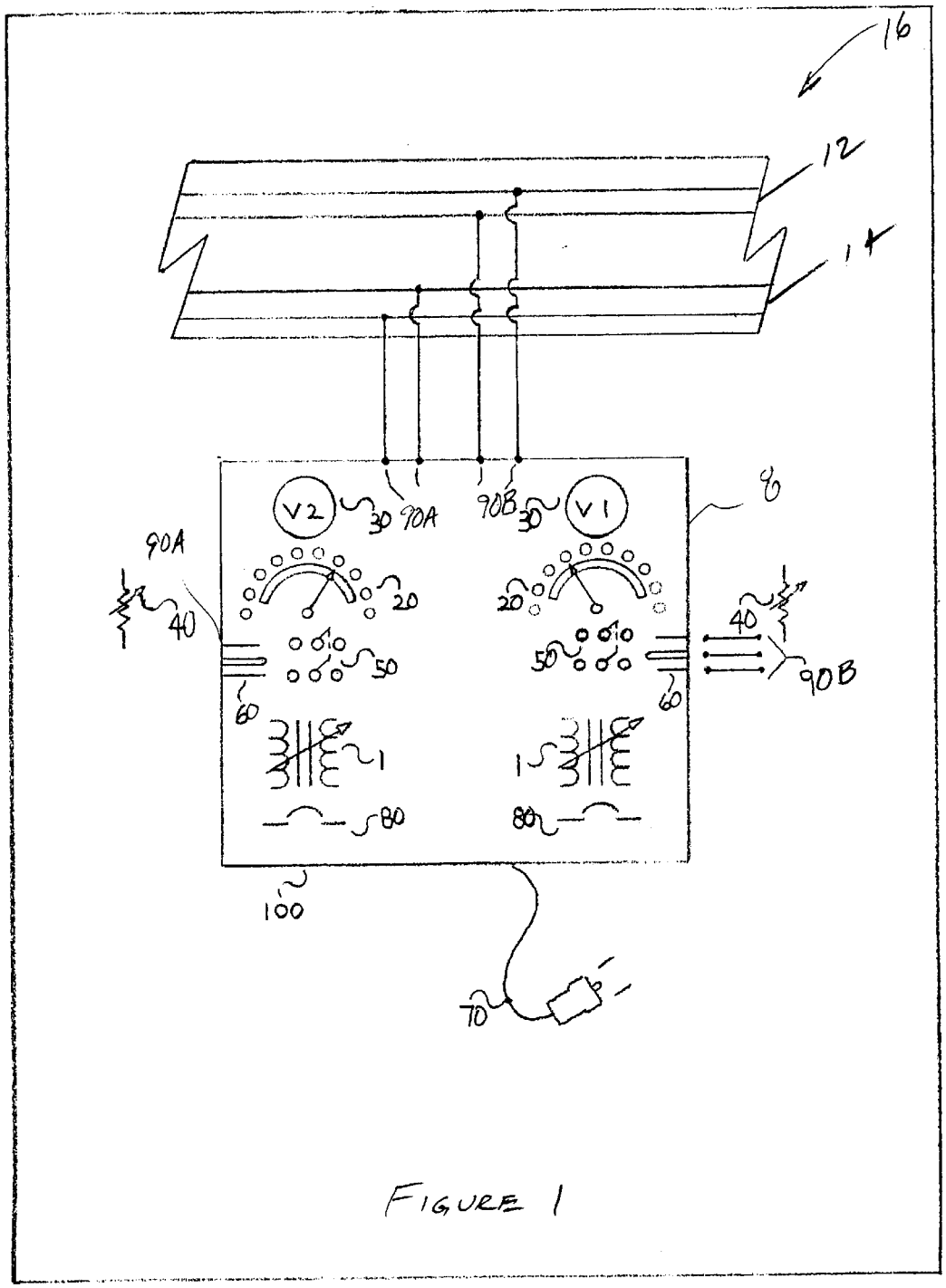
FIG. 1 is a schematic diagram of a two lane slot car track wherein each lane is in electrical communication with an adjustable regulated direct current power supply via an associated adjustable ohms rheostat controller in accordance with an exemplary embodiment.

Other objects, advantages and novel features of the invention will become more apparent from the following detailed description when taken in conjunction with the accompanying drawing.

DETAILED DESCRIPTION OF THE PREFERRED EMBODIMENT

Referring now to the Figures, a power supply 8 includes at least one n adjustable regulated direct current (DC) transformer 10 is configured as an adjustable power source for each lane 12 and 14 of a slot car track system 16 by stepping down an alternating current (AC) input voltage and converting it through an inverse voltage bridge rectifier (not shown) to produce DC, therefore providing power to each lane 12, 14 of the slot car track system 16. Each lane (e.g., lane 12 and lane 14) includes a corresponding adjustable regulated transformer 10. Each transformer 10 includes a corresponding voltage adjustable rheostat 20 configured to adjust the respective transformer 10 to provide a proper voltage available to the respective lane 12, 14. A reading of the voltage is accomplished by a corresponding direct current voltage meter 30. A corresponding adjustable ohms rheostat controller 40 introduces resistance between connection of each transformer to a respective lane 12, 14 so as to match the electric requirements of the slot car electric motor in electrical communication with that lane 12, 14.

In an exemplary embodiment, a double pole double throw switch (DPDT) 50 with a diode 52 (see FIG. 2) is operably connected between each controller 40 and an associated transformer 10. Each DPDT 50 includes six terminals 54 and a switch 56, e.g., two middle terminals between outside terminal pairs. A three port plug 60 provides a means to connect wire leads for hookups. A grounded UL listed AC cord and plug 70 provide a means for electrical connection with an AC power source (not shown). A circuit protector 80 is optionally included configured to protect and prevent damage to electronic and electrical equipment. Hook-up wire 90 is used to operably connect each controller 40 with an associated DPDT 50. Stranded UL listed wire is most efficient for DC use in such connections. For example, hook up wire 90A and 90B connects respective controllers 40 to lanes 14 and 12, respectively in FIG. 1. Power supply case enclosure 100 provides for protection of electronic and electrical components as well as other associated parts therein and permits dissipation of heat created within the power supply 8, maintaining a temperature for continuous operation.

Figure 2:
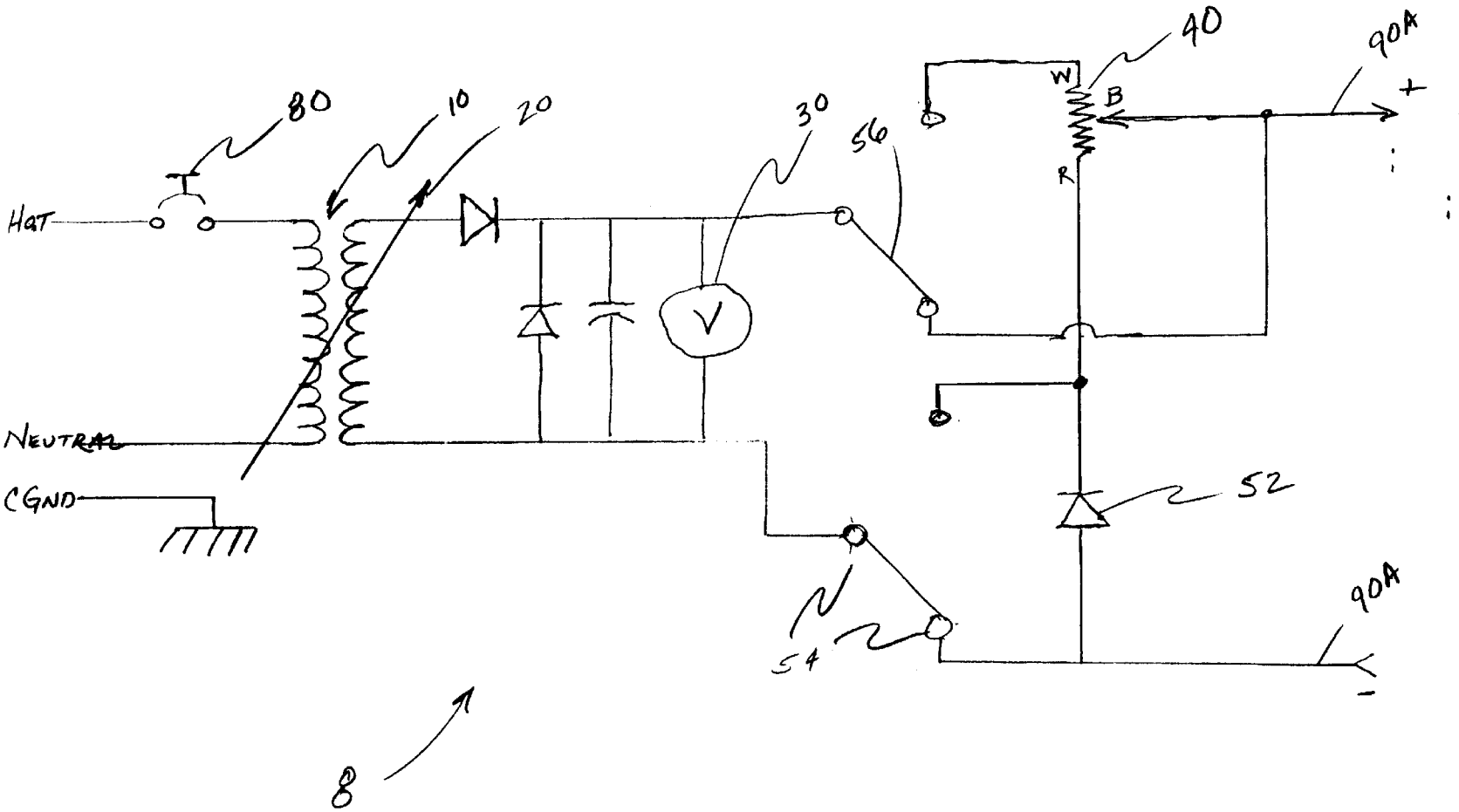
FIG. 2 is a more detailed electrical schematic of one of two variable transformers of FIG. 1 having a double pole double throw switch operably connected to one lane of the slot car track and switched to bypass an associated adjustable ohms rheostat controller.

The operation will now be described with reference to FIGS. 1 and 2.

The power supply case enclosure 100 with all of its components or parts is powered by grounded UL listed alternating current plug 70 receiving between 110 and 120 volts alternating current (AC). Hook-up wires or electrical conductors 90 connect the components or parts per the schematics depicted in FIGS. 1 and 2, or alternatively per a manufacturer's instructions. Circuit protector 80 checks for a short circuit or overload condition and shuts down the power supply if one of these conditions exists. If such a condition does not exist, adjustable regulated direct current transformer 10 allows for UL listed plug 7 with the 110 to 120 volts AC to be stepped-down and converted to volts DC which are measured through a direct current voltage meter 30. Alternatively, voltage adjustable rheostat 20 is included if transformer 10 is a fixed direct current transformer. Double pole double throw switch 50 allows the adjustable regulated direct current to go either to the slot car track lanes 12 and 14 allowing a corresponding slot car to run independently of controller 40 by controlling the slot car with an associated voltage adjustable rheostat 20, or to the adjustable ohms rheostat controller 40 through the three port plug 60 as seen best with reference to FIG. 2.

Fine tuning the resistance on the voltage adjustable rheostat 20 allows an operator to match the electric requirements of the slot car electric motor for a finer precision of operation for competitive racing purposes, as well as defining a range of precision for operation via the adjustable ohms rheostat controller 40. One advantages provided by each lane 12, 14 having a separate, individual adjustable regulated direct current power supply includes independent operation thereof independent of the other lane. In this respect, slot cars can run on their own akin to a model railroad, or alternatively, be raced against another slot car having different current requirements.

A latitude of the upgrade change and substitution is intended and in some instances some features of the invention will be employed without corresponding use of other features especially in matters of shape, size and arrangement of the components or parts within the principles of the invention. Accordingly, it is appropriate that the appended claims be construed broadly and in a manner consistent with the spirit and scope of the invention therein.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A power supply system for supplying power to a lane of a slot car track comprising:

an AC/DC transformer configured to supply a variably selected regulated DC power to the lane of the slot car track by means of at least one of an adjustable regulated direct current (DC) transformer and a voltage adjustable rheostat if said AC/DC transformer is a fixed direct current transformer; and a variable resistance means remote from said AC/DC transformer, said variable resistance means electrically disposed between said AC/DC transformer and a respective lane to which it is operably connected, said variable resistance means configured to further vary a resistance of said regulated DC power from said AC/DC transformer to said respective lane of the slot car track wherein the AC/DC transformer provides additional selectable control of power available to the slot car track that can be further varied by the variable resistance means.

2. The system of claim 1, further comprising:

a switch configured to bypass said variable resistance means thereby allowing DC power regulation of said DC power to said respective lane via said AC/DC transformer.

3. The system of claim 2, wherein said switch is a double pole double throw (DPDT) switch.

4. The system of claim 3, wherein said DPDT includes a diode operably connected thereto, said diode configured to prevent direct current from bypassing said variable resistance means when said switch is selected for direct current to pass through said variable resistance means.

5. The system of claim 1, wherein said variable resistance means includes an adjustable ohms rheostat controller.

6. The system of claim 5, wherein said an adjustable ohms rheostat controller is a hand controller.

7. The system of claim 6, wherein said hand controller is a three conductor controller.

8. The system of claim 1, wherein said AC/DC transformer is an adjustable regulated power supply configured to allow a different sized electric motor with different voltage requirements in the slot car to be run on a same said respective lane of the slot car track.

9. The system of claim 1, further comprising:

a voltage meter operably connected to said AC/DC transformer, said voltage meter configured to reflect said selected regulated DC power to said respective lane of the slot car track.

10. The system of claim 1, wherein an individual AC/DC transformer and corresponding variable resistance means is included for each lane of the slot car track.

11. The system of claim 1, wherein said AC/DC transformer is configured to allow for different voltage requirements to a winding of an electric motor of the slot car by adjustably regulating said selected regulated DC power to the slot car track independent of said variable resistance means.

12. A power supply system for supplying power to each lane of a plurality of lanes of a slot car track comprising:

an AC/DC transformer configured to supply a variably selected regulated DC power to each lane of the slot car track independent of any other lane by means of at least one of an adjustable regulated direct current (DC) transformer and a voltage adjustable rheostat if said AC/DC transformer is a fixed direct current transformer;

a variable resistance means remote from said AC/DC transformer, each said variable resistance means electrically disposed between said AC/DC transformer and a respective lane to which it is operably connected, said variable resistance means configured to further vary a resistance of said regulated DC power from said AC/DC transformer to said respective lane of the slot car track; and a switch, each switch configured to bypass said variable resistance means thereby allowing DC power regulation of said DC power to said respective lane via said AC/DC transformer corresponding to said respective lane wherein the AC/DC transformer provides additional selectable control of power available to each lane independent of any other lane, the power available to each lane can be further varied by said variable resistance means for the respective lane if a respective switch corresponding to the lane is not set to bypass said variable resistance means.

13. The system of claim 12, wherein said switch is a double pole double throw (DPDT) switch.

14. The system of claim 12, wherein said variable resistance means includes an adjustable ohms rheostat controller.

15. The system of claim 12, further comprising:

a voltage meter operably connected to each said AC/DC transformer, each said voltage meter configured to reflect said selected regulated DC power to said respective lane of the slot car track.

* * * * *